US009127414B2

(12) United States Patent
Steinhagen

(10) Patent No.: US 9,127,414 B2
(45) Date of Patent: Sep. 8, 2015

(54) PAVEMENT EDGE FORMING APPARATUS FOR PAVING MACHINE

(71) Applicant: Caterpillar Paving Products Inc., Brooklyn Park, MN (US)

(72) Inventor: Anthony P. Steinhagen, Minneapolis, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/172,116

(22) Filed: Feb. 4, 2014

(65) Prior Publication Data

US 2014/0154010 A1 Jun. 5, 2014

(51) Int. Cl.
*E01C 19/48* (2006.01)

(52) U.S. Cl.
CPC ..... *E01C 19/48* (2013.01); *E01C 2301/20* (2013.01)

(58) Field of Classification Search
CPC . E01C 2301/16; E01C 2301/20; E01C 19/48; E01C 19/4893; E01C 19/40
USPC ..... 404/93, 96, 104, 105
See application file for complete search history.

(56) References Cited

U.S. PATENT DOCUMENTS

| | | | | |
|---|---|---|---|---|
| 6,238,134 | B1 * | 5/2001 | Sovik | 404/72 |
| 6,273,636 | B1 * | 8/2001 | Johanpeter | 404/104 |
| 6,283,672 | B1 * | 9/2001 | Sovik | 404/72 |
| 6,923,594 | B2 * | 8/2005 | Sovik et al. | 404/96 |
| 6,988,850 | B2 * | 1/2006 | Sovik et al. | 404/98 |
| 8,491,221 | B1 * | 7/2013 | Hedin | 404/96 |
| 8,591,142 | B2 * | 11/2013 | Mittleman | 404/98 |
| 8,757,923 | B1 * | 6/2014 | Comer et al. | 404/104 |
| 2004/0218978 | A1 * | 11/2004 | Sovik et al. | 404/96 |
| 2012/0183350 | A1 | 7/2012 | Mittleman | |

OTHER PUBLICATIONS

"Safety Edge Safely Paving the Way", Carlson Paving Products, Inc., Web page available at: http://www.carlsonpavingproducts.com/downloads/SafetyEdgebrochure.pdf, 2 pages.

"Advant-Edger User Manual", Advant-Edge Paving Equipment, LLC, Web page available at: http://www.transportation.wv.gov/highways/mcst/Documents/current_approved_lists/1244047263_Advant_Edger_Universal_Model_Manual_May_09.pdf, pp. 1-14, 2010.

Priscilla Tsai, "Saving Lives with the Safety Edge", Web page available at: http://www.carlsonpavingproducts.com/downloads/August2012.pdf, Jul. 23, 2012, 3 pages.

* cited by examiner

*Primary Examiner* — Abigail A Risic

(57) ABSTRACT

A paving machine includes a screed. The screed further includes an endgate, a mount, a platform, and a pavement edge forming member. The pavement edge forming member has a longitudinal member and a shaping plate coupled to the longitudinal member and is inclined at an angle to a non-paved surface. The shaping plate is configured to form a ramped surface between a mat and the non-paved surface.

1 Claim, 3 Drawing Sheets

PAVEMENT EDGE FORMING APPARATUS FOR PAVING MACHINE

TECHNICAL FIELD

The present disclosure relates generally to a paving machine. More specifically, the present disclosure relates to a pavement edge forming apparatus for the paving machine.

BACKGROUND

Paving machines are commonly used to lay material such as asphalt or concrete on roads, bridges, parking lots, and other construction sites. Paving machines may further provide minor compaction to the laid material to form a mat on a paving surface. Paving machines generally include a screed to provide initial compaction to the mat. The screed may be extended or retracted depending on a desired width of the mat. An endgate may be coupled to the screed and may further be configured to move along the mat with the screed. The endgate prevents the material being laid from spilling over a non-paved surface.

The movement of the endgate with the screed may form a steep edge between the mat and the non-paved surface. The steep edge may cause inconvenience for an operator of a vehicle when the vehicle leaves the road surface and tries to return to the road surface. The inconvenience to the operator may be avoided by shaping the steep edge of the mat into a ramped surface between the mat and the non-paved surface.

The ramped surface between the mat and the non-paved surface is known in the art as a pavement edge or a safety edge. One way to form the pavement edge is to use a wedge-shaped attachment between an extender of the screed and a frame of a paving machine. However, using such attachment may prevent the extension and/or retraction of the screed. Another way to form the pavement edge is to use a tapered endgate shoe. The use of the tapered endgate shoe may reduce efficiency of the pavement edge forming operation. Further, the use of tapered endgate shoe may result in a significant amount of maintenance and cost.

SUMMARY OF THE DISCLOSURE

The present disclosure provides a paving machine including a screed. The screed further includes an endgate, a mount, a platform, and a pavement edge forming member. The pavement edge forming member has a longitudinal member and a shaping plate coupled to the longitudinal member and is inclined at an angle to a non-paved surface. The shaping plate is configured to form a ramped surface between a mat and the non-paved surface. The pavement edge forming member is coupled to the mount and the mount is coupled to the endgate. The pavement edge forming member is adjustable along a vertical length of the mount and is held in place by a locking mechanism. The pavement edge forming member is located between the platform and the endgate.

DETAILED DESCRIPTION OF DRAWINGS

Detailed embodiments of the present disclosure are described herein with reference to the following figures. The specific structural and functional details disclosed herein are intended to be exemplary and should not be interpreted as limiting the disclosure.

Figure 1:
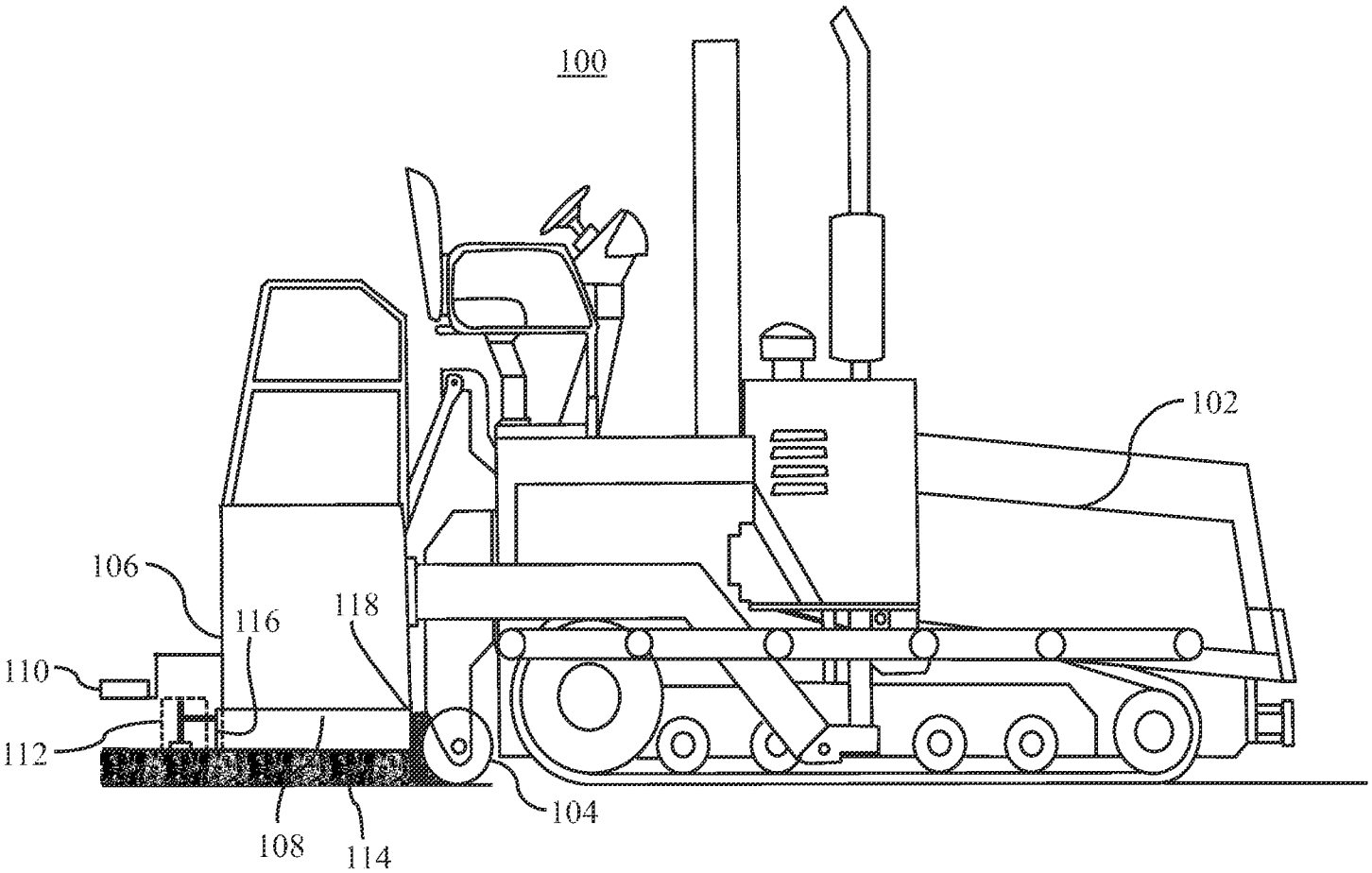
FIG. 1 is a side view of an exemplary paving machine, in accordance with the concepts of the present disclosure.

FIG. 1 is a side view of an exemplary paving machine 100, according to the present disclosure. In FIG. 1, a paving machine 100 includes a pair of hoppers 102, a conveyor, an auger 104, a screed 106, an endgate 108, a platform 110 and a pavement edge forming apparatus 112.

The pair of hoppers 102 are configured to receive asphalt from a dump truck or by any other material transfer means. Further, the pair of hoppers 102 operate to move in a generally up and down direction to dump asphalt onto the conveyor. The conveyor is positioned between the pair of hoppers 102. The conveyor is configured to supply the asphalt to the auger 104.

The auger 104 is configured to lay and distribute asphalt on a paving surface. The auger 104 dumps the asphalt on the paving surface ahead of the screed and works to distribute the asphalt on the paving surface. The screed 106 is configured to provide compaction to the stockpile to form an asphalt mat 114. The endgate 108 may be attached to each end of the screed 106 to define an edge of the mat 114.

The endgate 108 may limit the mat 114 to a desired width. The endgate 108 may further prevent asphalt from spilling on a non-paved surface. The endgate 108 comprises a first end 116 and a second end 118. The first end 116 is in proximity to the screed 106 and the second end 118 is in proximity to the auger 104.

The platform 110 may be installed behind the screed 106. The platform 110 is a walkway platform that enables an operator to stand and inspect the mat 114. The operator may inspect various aspects of the mat 114 such as leveling of the mat 114, surface finish, and the like.

The pavement edge forming apparatus 112 is configured to shape a steep edge of the mat 114 into a ramped surface. The pavement edge forming apparatus 112 may be positioned laterally between the screed 106 and the platform 110. Further, the pavement edge forming apparatus 112 may be coupled to the endgate 108. In an exemplary embodiment, the pavement edge forming apparatus 112 is located on the rear of the endgate 108. The ramped surface is formed between the mat 114 and the non-paved surface. The ramped surface is inclined at an angle to the non-paved surface. The non-paved surface may refer to a surface alongside the mat 114.

Figure 2:
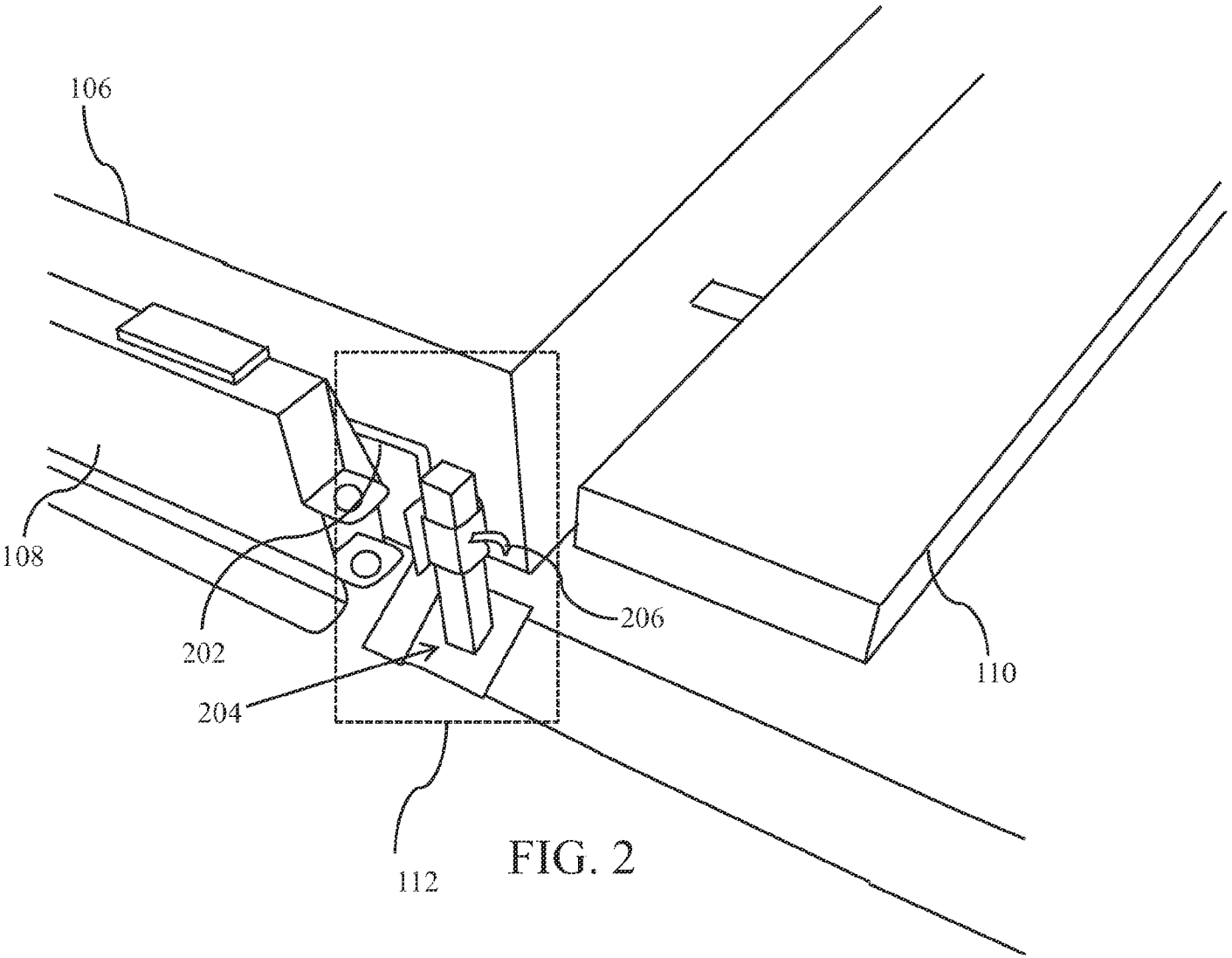
FIG. 2 is an enlarged perspective view of a rear portion of the paving machine, in accordance with the concepts of the present disclosure.

FIG. 2 is an enlarged perspective view of a rear portion of the paving machine 100, in accordance with the concepts of the present disclosure. FIG. 2 is described in conjunction with the elements from FIG. 1. In reference to FIG. 2, the pavement edge forming apparatus 112 includes a mount 202, a pavement edge forming member 204, and a locking mechanism 206.

In an embodiment, the mount 202 may be coupled to the first end 116 of the endgate 108, which is the rear portion of the screed. In an exemplary embodiment, the mount 202 is attached to the rear portion of the endgate 108. The pavement edge forming member 204 may be detachably engaged with the mount 202. The mount 202 has a vertical length along which the pavement edge forming member 204 may be raised or lowered based on a requirement of a paving operation. The pavement edge forming member 204 is discussed later in the document with reference to FIG. 3. The locking mechanism 206 is configured to hold the pavement edge forming member 204 within the mount 202 at a desired position required for the paving operation. The locking mechanism 206 may be operated to raise or lower the pavement edge forming member 204 above the paving surface. The locking mechanism 206 may be, but not limited to, a lead screw mechanism, a spring loaded lock pin assembly, a hydraulic cylinder etc. However, the type of locking mechanism does not affect the functionality or scope of the present disclosure.

Figure 3:
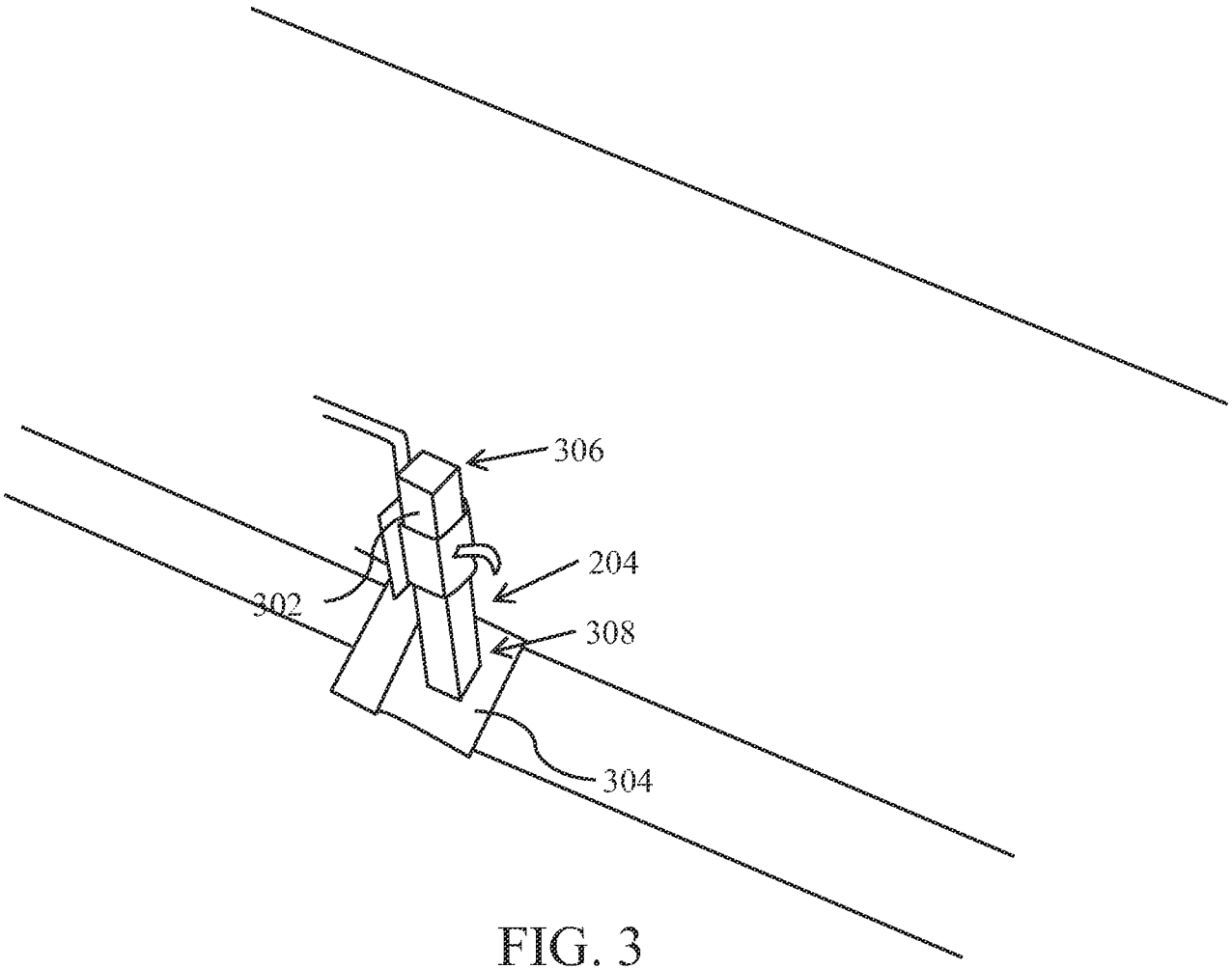
FIG. 3 is a perspective view of a pavement edge forming member, in accordance with the concepts of the present disclosure.

FIG. 3 is a perspective view of a pavement edge forming member 204, in accordance with the concepts of the present disclosure. FIG. 3 is described in conjunction with elements from FIG. 2. In reference to FIG. 3, the pavement edge forming member 204 includes a longitudinal member 302 and a shaping plate 304. The longitudinal member 302 is configured to be placed within the mount 202 to engage the pavement edge forming member 204 with the paving machine 100. Further, the longitudinal member 302 may comprise a first end 306 and a second end 308.

The shaping plate 304 is configured to shape the steep edges of the mat 114 into the ramped surface. The shaping plate 304 may be coupled to the second end 308 of the longitudinal member 302. The shaping plate 304 may be coupled to the longitudinal member 302 such that the shaping plate is at an angle to a horizontal plane. The horizontal; plane is substantially parallel to the non-paved surface. In an embodiment, the shaping plate 304 may be a metal plate or any other type of plate known in the art to shape the steep edge of the mat 114. The shaping plate 304 may be coupled to the longitudinal member 302 with a weld joint, or any other technique known in the art. However, it is evident to a person with ordinary skills in the art that the technique used to couple the shaping plate 304 and the longitudinal member 302, in no way affects the scope of the present disclosure.

In an embodiment, the shaping plate 304 may be coupled to the longitudinal member 302 is such a way that the plate 304 is adjustable with respect to the longitudinal member. The shaping plate 304 may be adjustable in a direction of travel and/or in a direction perpendicular to the direction of travel. Generally, the shaping plate 304 is set at a predetermined angle defining the slope of the pavement edge from the unpaved surface to the mat. In an alternative embodiment, the shaping plate 304 may be adjustable to allow the slope of the pavement edge to change.

INDUSTRIAL APPLICABILITY

In operation, the hoppers 102 move the asphalt onto the conveyor. The conveyor supplies the asphalt to the auger 104. The auger 104 distributes the asphalt onto the paving surface. The screed 106 may transform the stockpile on the paving surface into the mat 114. When the screed 106 further distributes and compacts the asphalt into the mat 114. The endgate 108 is attached to the screed 106 and moves along with the screed 106. The position of the endgate 108 defines the width of the mat 114 and prevents the asphalt from spilling onto the non-paved surface. The pavement edge forming apparatus 112 is coupled to the endgate 108. The paving edge forming apparatus 112 has a shaping plate 304 that creates a pavement edge.

Thus, the present disclosure provides the pavement edge forming apparatus 112 to transform the steep edge into the ramped surface. The transformation of the steep edge to the ramped surface reduces the inconvenience to the operator, when the vehicle leaves or tries to enter the mat 114. The disclosure further provides a portable and less expensive attachment to form the ramped surface. The pavement edge forming apparatus 112 enables the screed 106 to retract fully from an extended width to a basic width of the screed 106 during operation.

It should be understood that the above description is intended for illustrative purposes only and is not intended to limit the scope of the present disclosure in any way. Thus, those skilled in the art will appreciate that other aspects of the disclosure can be obtained from a study of the drawings, the disclosure, and the appended claim.

What is claimed is:

1. A paving machine, the paving machine comprises:

a screed, wherein the screed comprises an endgate, a mount, a platform, and a pavement edge forming member;

wherein the pavement edge forming member comprises:

a longitudinal member; and a shaping plate coupled to the longitudinal member and is inclined at an angle to a non-paved surface, wherein the shaping plate is configured to form a ramped surface between a mat and the non-paved surface;

wherein the pavement edge forming member is coupled to the mount and the mount is coupled to the endgate;

wherein the pavement edge forming member is adjustable along a vertical length of the mount and is held in place by a locking mechanism; and wherein the pavement edge forming member is located between the platform and the endgate.

* * * * *